US006723010B2

(12) United States Patent
Gill

(10) Patent No.: US 6,723,010 B2
(45) Date of Patent: Apr. 20, 2004

(54) APPARATUS FOR HANDLING A GOLF BALL AND TEE

(76) Inventor: Joseph Gill, 6560 Wild Oaks Dr., Toledo, OH (US) 43615

( * ) Notice: Subject to any disclaimer, the term of this patent is extended or adjusted under 35 U.S.C. 154(b) by 0 days.

(21) Appl. No.: 10/234,655

(22) Filed: Sep. 4, 2002

(65) Prior Publication Data

US 2003/0069090 A1 Apr. 10, 2003

Related U.S. Application Data

(60) Provisional application No. 60/317,350, filed on Sep. 4, 2001.

(51) Int. Cl.[7] ..... A63B 57/00
(52) U.S. Cl. ..... 473/386
(58) Field of Search ..... 473/386, 282, 473/286; 294/19.1, 19.2

(56) References Cited

U.S. PATENT DOCUMENTS

| | | | | |
|---|---|---|---|---|
| 2,609,198 A | | 9/1952 | Armstrong | |
| 4,360,199 A | * | 11/1982 | Jackson | 473/132 |
| 4,526,369 A | | 7/1985 | Phelps | |
| 4,589,661 A | | 5/1986 | Attig | |
| 4,714,250 A | * | 12/1987 | Henthorn | 473/133 |
| 4,969,646 A | | 11/1990 | Tobias | |
| 5,171,010 A | * | 12/1992 | Lanoue | 473/132 |
| 5,192,104 A | | 3/1993 | Lin | |
| 5,205,598 A | | 4/1993 | Miller | |
| 5,330,178 A | | 7/1994 | Geishert | |
| 5,439,213 A | | 8/1995 | Pimentel | |
| 5,669,646 A | | 9/1997 | Fiocca et al. | |
| 5,672,121 A | | 9/1997 | Miller | |
| D386,053 S | | 11/1997 | James | |
| 5,707,303 A | * | 1/1998 | Berkowitz et al. | 473/386 |
| 6,004,227 A | | 12/1999 | Petersen | |

* cited by examiner

*Primary Examiner*—Steven Wong
(74) *Attorney, Agent, or Firm*—David C. Purdue; John C. Purdue

(57) ABSTRACT

Apparatus for gripping a golf ball and a tee therefor, and for inserting the tee into the ground with the ball thereon, is disclosed. The apparatus comprises a body member with a handle and a grip. The grip comprises (a) a ball support, (b) an arm and (c) means mounting the arm for rotation between a closed position and an open position. The ball support has an opening which receives a golf ball; the arm has a slot that receives a tee. When the arm is closed, a tee in the slot in the arm urges a golf ball into the opening of the ball support, and the shank of the tee is exposed so that it can be inserted into the ground; in the open position, a ball seated on the head of a tee received in the slot of the arm is spaced from the opening of the ball support.

1 Claim, 3 Drawing Sheets

APPARATUS FOR HANDLING A GOLF BALL AND TEE

CROSS-REFERENCE TO RELATED APPLICATIONS

Priority is claimed based upon Provisional application No. 60/317,350, filed Sep. 04, 2001.

STATEMENT CONCERNING FEDERALLY SPONSORED RESEARCH OR DEVELOPMENT

Not applicable

REFERENCE TO A "SEQUENCE LISTING"

Not applicable

BACKGROUND OF THE INVENTION (1) Field of the Invention

This invention relates to apparatus for handling a golf ball and tee, and, more particularly, to such apparatus which can be used by a person who remains in a standing position to insert a golf ball tee into the ground, with a ball thereon, ready for a shot.

(2) Description of Related Art Including Information Disclosed under 37 CFR 1.97 and 37 CFR 1.98

Apparatus for handling a golf ball and tee is known, being disclosed in numerous U.S. patents, including the following, which were found on a pre-examination search:

U.S. Pat. No. 6,004,227, Petersen, Dec. 21, 1999

U.S. Pat. No. 5,672,121, Miller, Sep. 30, 1997

U.S. Pat. No. 5,669,646, Fiocca et al., Sep. 23, 1997

U.S. Pat. No. 5,439,213, Pimentel, Aug. 8, 1995

U.S. Pat. No. 5,330,178, Geishert, Jul. 19, 1994

U.S. Pat. No. 5,205,598, Miller, Apr. 27, 1993

U.S. Pat. No. 4,969,646, Tobias, Nov. 13, 1990

U.S. Pat. No. 4,589,661, Attig, May 20, 1986

U.S. Pat. No. 4,526,369, Phelps, Jul. 2, 1985

U.S. Pat. No. 2,609,198, Armstrong, Sep. 2, 1952

All of the foregoing patents relate to apparatus for handling a golf ball and tee, and, specifically, to such apparatus which can be used by a person who remains standing to position a golf ball tee in the ground, with a ball thereon, ready for a shot. None of the patents, however, suggests such apparatus where a ball is gripped between a resilient toroidal ring and a tee which is received in a slot in a first end of an arm which is pivoted at a second end, and can be urged manually into a rotational position where the first end of the arm urges the tee against the ball and the ball into contact with the toroidal ring, and is resiliently urged toward a second rotational position where the distance between the first end of the arm and the toroidal ring is sufficiently great that the ball and the tee are not engaged between the ring and the arm.

Apparatus which is not disclosed for use to position a golf ball tee in the ground, with a ball thereon, but where an object is gripped between a support and the first end of an arm which is pivoted at a second end, and can be urged manually into a rotational position where the first end of the arm urges an object to be supported against the object and into contact with the support, and is resiliently urged toward a second rotational position where the distance between the support and the first end of the arm is sufficiently great that the object is not engaged between the support and the arm is disclosed in Design Pat. No. 386,053, Gavin Hugh James, Nov. 11, 1997, and in U.S. Pat. No. 5,192,104, Lin, Mar. 9, 1993.

BRIEF SUMMARY OF THE INVENTION

The instant invention is apparatus for handling a golf ball and tee which can be used by a person who remains standing to position a golf ball tee in the ground, with a ball thereon, ready for a shot. In the apparatus, a ball is gripped between a resilient toroidal ring and a tee which is received in a slot in a first end of an arm which is pivoted at a second end, and can be urged manually into a rotational position where the first end of the arm urges the tee against the ball and the ball into contact with the toroidal ring, and is resiliently urged toward a second rotational position where the distance between the first end of the arm and the toroidal ring is sufficiently great that the ball and the tee are not engaged between the ring and the arm.

DETAILED DESCRIPTION OF THE INVENTION

Figure 1:
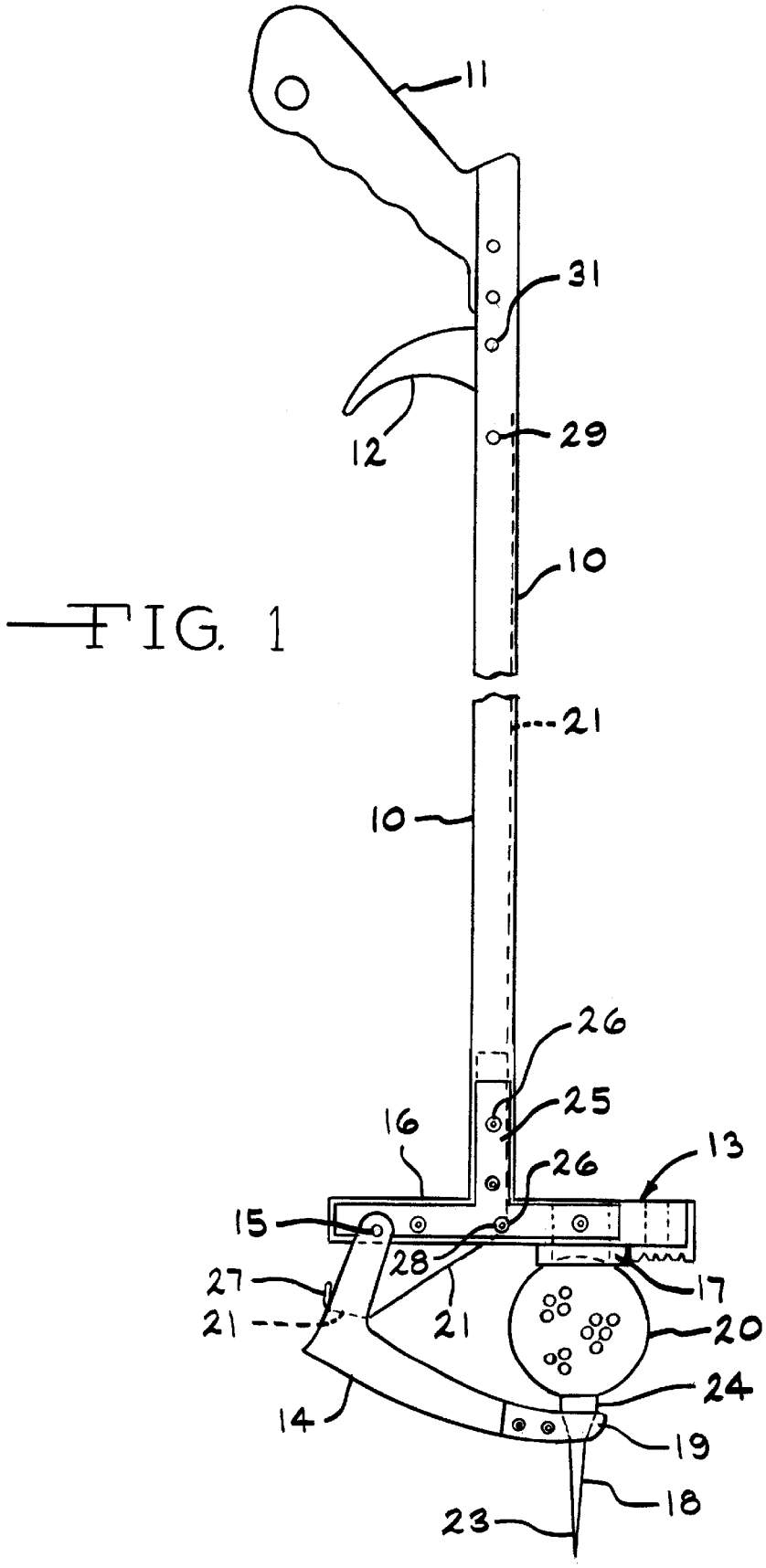
FIG. 1 is a front view of the apparatus of the invention, showing a ball gripped between a resilient toroidal ring and a tee which is received in a slot in a first end of an arm of the apparatus.
Figure 2:
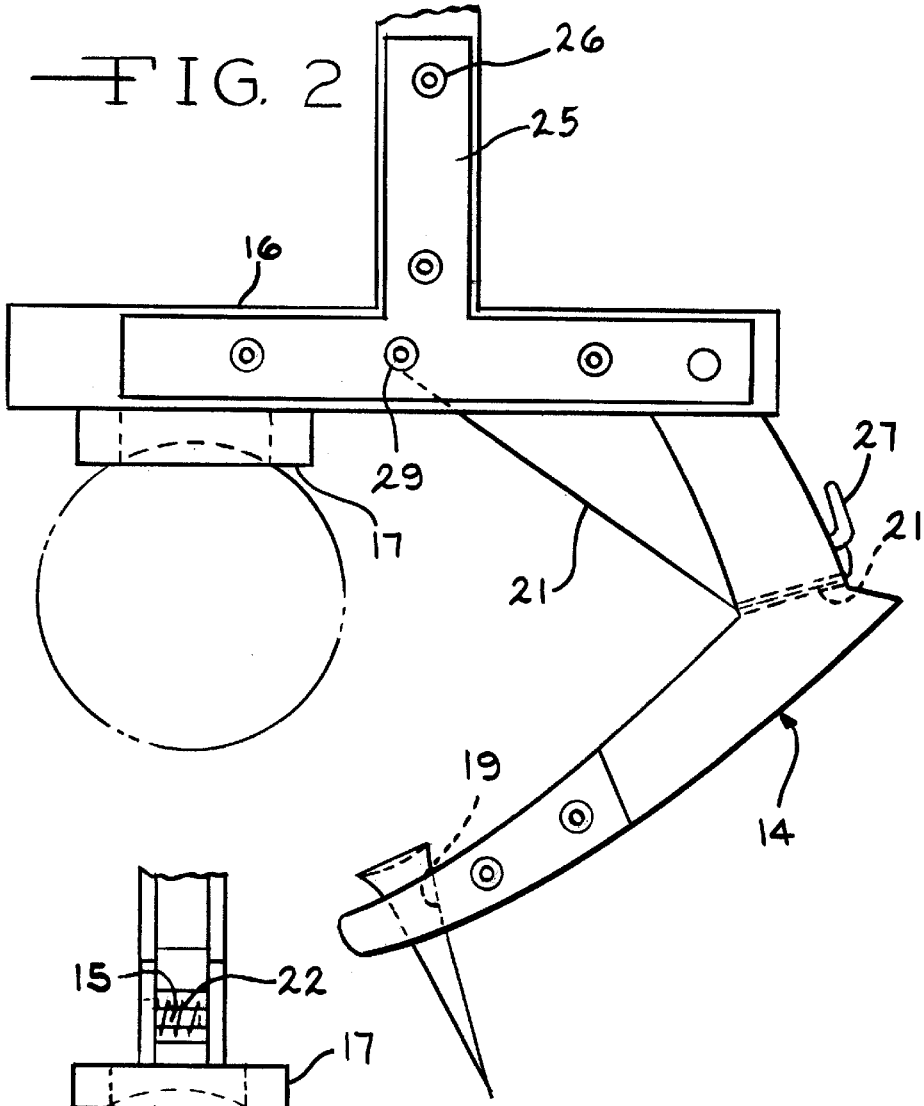
FIG. 2 is an enlarged back view of an end of the apparatus of FIG. 1, showing the toroidal ring and the arm which has a slot in its first end, but in a second rotational position where a ball (which is shown in dotted lines) would not be gripped between the ring and a tee in the slot thereof.

Referring to FIG. 1, apparatus according to the invention comprises an elongated channel 10 with a handle 11 and a trigger 12 at one end and a ball and tee supporting mechanism indicated generally at 13 at the other end thereof. The mechanism 13 comprises an arm 14 which is rotatably mounted by a pin 15 on opposed crossarms 16 (one of which is shown in FIGS. 1 and 2) and a resilient toroidal member 17 which is also carried by the opposed crossarms 16. The arm 14 is rotatable about the pin 15 between a first position shown in FIG. 1 where, when it is urged as subsequently described, toward the crossarms 16, a tee 18 received in a slot 19 therein urges a golf ball 20 against the toroidal member 17, so that the tee 18 can be pushed into the ground to a desired depth.

Figure 3:
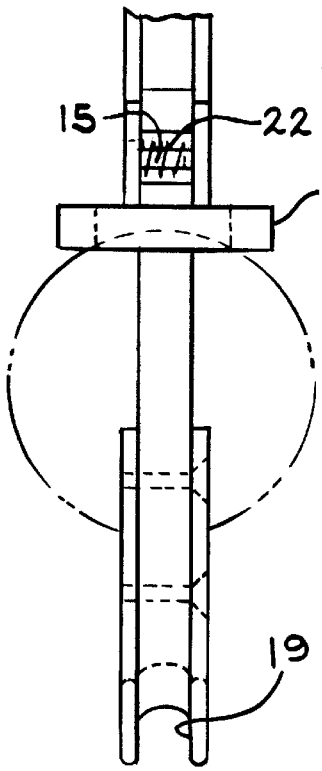
FIG. 3 is a side view of a portion of the apparatus of FIGS. 1 and 2, showing the toroidal ring and a spring which urges the arm toward the second rotational position.

When the trigger 12 is urged toward the handle 11, a cable 21 urges the arm 14 to rotate in a counter clockwise direction, so that the tee 18 and the ball 20 are urged upwardly, and the latter bears against the toroidal member 17. After the tee 18 is pushed into the ground, the trigger 12 can be released, whereupon a spring 22 (FIG. 3) around the pin 15 urges the arm 14 (FIG. 1) to rotate in a clockwise direction so that the crossarms 16 can be moved upwardly from the position shown away from the ball 20, whereupon the ball and tee supporting mechanism 13 can be moved laterally to the left from the FIG. 1 position, leaving the ball 20 on the tee 19, ready to be played.

When it is next time to place the ball 20 on the tee 18, the latter can be inserted in the slot 19 and the ball 20 can be held on the tee 18; thereupon, the trigger 12 can be urged toward the handle 11 until the position shown in FIG. 1 is reached. Pressure urging the trigger 12 toward the handle 11 will then hold the assembly in the position shown until the tee 18 is again pushed into the ground to a desired depth, whereupon the trigger 12 can be released, the crossarms 16 can be moved upwardly, and the ball and tee supporting mechanism 13 can be moved laterally as described, leaving the ball 20 on the tee 18, ready to be played again.

It will be appreciated that the tee 18 is conventional, having a shank 23 which is pushed into the ground to hold a ball and a head 24 with a concave upper surface in which the ball 20 is received in FIG. 1, and when the shank 23 is in the ground and a ball is on the tee in preparation for a shot.

Figure 4:
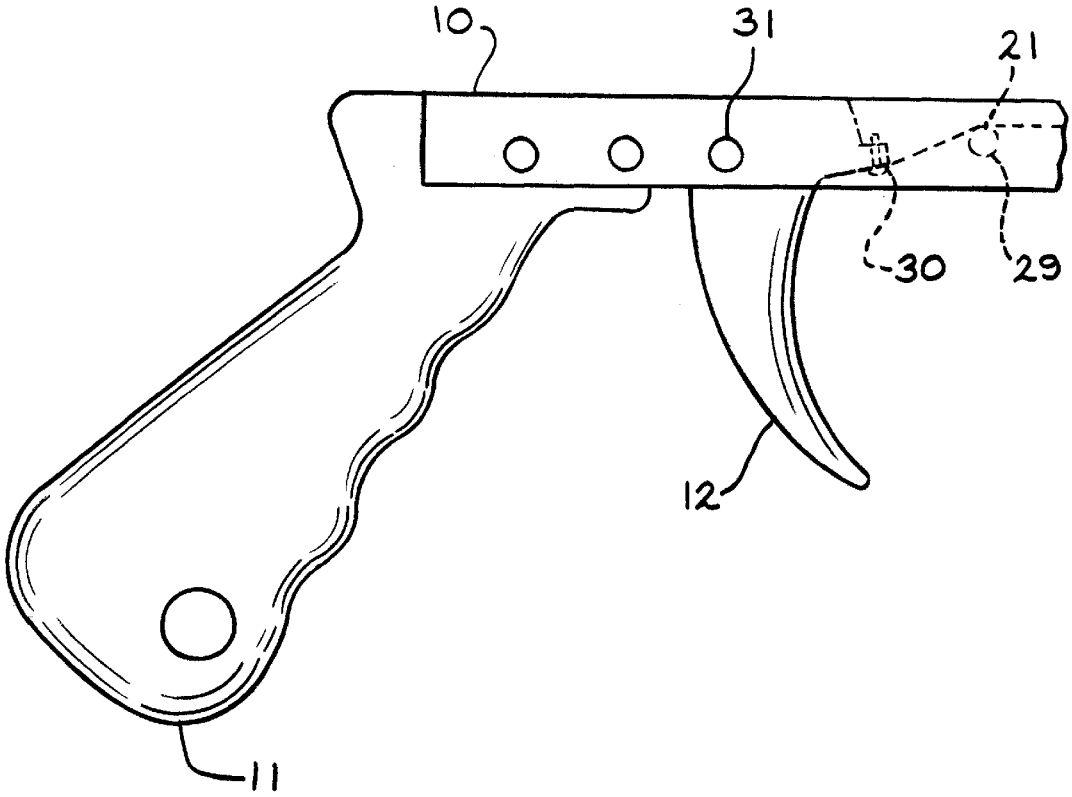
FIG. 4 is an enlarged front view of a second end of the apparatus of FIG. 1.

Each of the crossarms 16 has an integral leg 25 which is attached by fasteners 26 to one side of the channel 10. The cable 21 is anchored to the arm 14 as indicated at 27, and passes through the arm, upwardly and to the right, over a pin 28, through the interior of the channel 10 and over a pulley 29 to the trigger 11, to which it is anchored as indicated at 30 (FIG. 4). A pin 31 mounts the trigger 12 for rotational movement relative to the channel 10.

It will be appreciated that various changes and modifications can be made from the specific details of the invention as set forth herein, and that, in its essential details, the invention is apparatus for gripping a golf ball and a tee therefor, while the tee is inserted in the ground with the ball thereon, and that the apparatus comprises a longitudinally extending body member with a handle and gripping means at opposed ends thereof. The gripping means comprises (a) a ball support, (b) an arm which has a slot that is operable to receive a tee having a head with a ball-receiving recess and a shank for insertion into the ground, (c) means mounting the arm for rotation between a closed position and an open position, and means for causing the arm to rotate into the closed position. The ball support has an opening which extends inwardly from an exposed surface and is operable to receive a golf ball so that a part of the ball extends into the opening and the ball makes contact with an edge of the opening which is adjacent the exposed surface; the points of contact between the ball and the edge of the opening are at least substantially in a plane which is generally at a right angle to the axis of the body member. A portion of the surface of a golf ball which extends into the opening of the ball support is received in the ball-receiving recess of the head of a tee received in the slot of the arm when the arm is in the closed position. When the arm is in the closed position, the shank of the tee in which the ball is received is exposed so that it can be inserted in the ground. When the arm is in an open position, the head of a tee received in the slot of the arm is spaced from a golf ball which extends into the opening of the ball support.

In a preferred embodiment, the means for causing the arm to rotate into the closed position comprises a cable which is attached to the arm and to a trigger which is pinned to the body member adjacent the handle. In another preferred embodiment, the apparatus additionally includes means operable to urge the arm to rotate toward its open position. In still another preferred embodiment, the apparatus additionally includes a crossarm attached to the body member at the end thereof opposite the handle; the crossarm extends generally at a right angle to the axis of the body member; the arm is pinned to the crossarm; and the ball support is mounted on the crossarm.

It will be appreciated that various changes and modifications can be made from the specific details of the invention as described herein and shown in the attached drawings without departing from the spirit and scope thereof as defined in the attached claims.

What is claimed is:

1. Apparatus for gripping a golf ball and a tee therefor, while the tee is inserted in the ground with the ball thereon, said apparatus comprising a longitudinally extending body member with a handle and gripping means at opposed ends thereof, said gripping means comprising (a) a ball support having an opening which extends inwardly from an exposed surface and is operable to receive a golf ball so that a part of the ball extends into the opening and the ball makes contact with an edge of the opening which is adjacent the exposed surface, the points of contact between the ball and the edge of the opening being at least substantially in a plane which is generally at a right angle to the axis of the body member, said ball support being mounted on a crossarm which is attached to said body member at the end thereof opposite said handle, said crossarm extending generally at a right angle to the axis of said body member, (b) an arm which is pinned to said crossarm and has a slot that is operable to receive a tee having a head with a ball-receiving recess and a shank for insertion into the ground, and (c) means mounting said arm for rotation between a closed position in which a portion of the surface of a golf ball which extends into the opening of said ball support is received in the ball-receiving recess of the head of a tee received in the slot of said arm and the shank of the tee is exposed so that it can be inserted into the ground and an open position in which the head of a tee received in the slot of said arm is spaced from a golf ball which extends into the opening of said ball support, means operable to urge said arm to rotate toward its open position, and means which comprises a cable attached to said arm and to a trigger which is pinned to said body member adjacent said handle for causing said arm to rotate into the closed position.

* * * * *